US005674107A

United States Patent [19]

Graebner et al.

[11] Patent Number: 5,674,107

[45] Date of Patent: Oct. 7, 1997

[54] DIAMOND POLISHING METHOD AND APPARATUS EMPLOYING OXYGEN-EMITTING MEDIUM

[75] Inventors: John Edwin Graebner, Short Hills; Sungho Jin, Millington; Guenther Wilhelm Kammlott, Watchung; Wei Zhu, North Plainfield, all of N.J.

[73] Assignee: Lucent Technologies Inc., Murray Hill, N.J.

[21] Appl. No.: 429,263

[22] Filed: Apr. 25, 1995

[51] Int. Cl.[6] ..... B24B 1/00

[52] U.S. Cl. ..... 451/28; 451/41

[58] Field of Search ..... 451/41, 36, 59, 451/37, 269–271, 464, 465, 336, 356, 2, 8; 216/88, 89

[56] References Cited

U.S. PATENT DOCUMENTS

| | | | |
|---|---|---|---|
| 3,063,204 | 11/1962 | Baumgartner | 451/270 |
| 3,841,031 | 10/1974 | Walsh | 451/41 |
| 4,527,360 | 7/1985 | Dicke | 451/356 |
| 5,058,328 | 10/1991 | Steere et al. | 451/336 |
| 5,136,820 | 8/1992 | Luther | 451/36 |
| 5,157,876 | 10/1992 | Medellin | 451/36 |
| 5,191,738 | 3/1993 | Nakazato et al. | 451/41 |
| 5,421,769 | 6/1995 | Schultz et al. | 451/41 |
| 5,472,370 | 12/1995 | Malshe et al. | 451/41 |

*Primary Examiner*—James G. Smith
*Assistant Examiner*—Derris H. Banks
*Attorney, Agent, or Firm*—Glen E. Books

[57] ABSTRACT

A novel technique for fine polishing surfaces of diamond to the submicron level involves applying to the diamond surface an oxygen-emitting polishing medium, either a dry powder or a powder dispersed in a liquid carrier. The diamond surface is then polished by high speed rubbing to a submicron finish by inducing oxygen emission and oxygen-carbon interaction. Several embodiments of apparatus for polishing are described.

10 Claims, 3 Drawing Sheets

DIAMOND POLISHING METHOD AND APPARATUS EMPLOYING OXYGEN-EMITTING MEDIUM

FIELD OF THE INVENTION

This invention relates to methods and apparatus for fine polishing of diamond films and crystals. The method uses an oxygen-emitting polishing medium which, upon mechanical abrasion, causes diamond polishing at elevated or near-ambient temperatures.

BACKGROUND OF THE INVENTION

It is well known that diamond has many useful properties. Among the known materials, diamond has the highest mechanical hardness, the highest elastic modulus, the highest atomic density and the highest thermal conductivity at room temperature. In addition, diamond is chemically inert and is transparent to radiation from the ultraviolet to the infrared. Diamond can also be made into a wide band-gap semiconductor useful at high temperature and high voltage conditions. These remarkable properties, in combination with the relative ease of growing diamond films, have made diamonds desirable as heat spreaders for high power electronic devices, optical windows, low-friction or wear-resistant surfaces, coatings for cutting tools, and components for active electronic devices.

Nearly all diamond applications require shaping, and thinning or polishing to produce a finished surface roughness below one micrometer. An even finer finish (below ~1000 angstroms roughness) is desirable for certain applications such as optical windows where surface roughness is detrimental to light transmission. Diamond films produced by chemical vapor deposition (CVD films), typically exhibit faceted growth surfaces with an undesirable roughness. In addition, the bottom layer of the film (where diamond nucleation and initial growth takes place) consists of fine grains with many gain boundaries, producing inferior thermal and optical properties. For these reasons, it is desirable to remove both the top and bottom parts of the as-grown diamond films. Unfortunately, because of the hardness of diamond, thinning and polishing by conventional mechanical abrasion is time-consuming and costly.

Low-cost, high-speed diamond thinning techniques using diffusional interactions with carbon-dissolving metals have been reported in recent years. See, for example, Jin et at., *Nature* Vol. 362, p. 822 (1993) and *Diamond and Related Materials,* Vol. 1, p. 822 (1992). These techniques typically use high-speed, high-temperature reactions at 700°–900° C. and produce etched diamond surfaces with a coarse surface roughness of a micron or more. Even after this treatment the etched diamond requires further polishing to achieve submicron-scale smooth surfaces. Accordingly, there is a need for a convenient and inexpensive polishing technique to produce smooth diamond surface finishes.

SUMMARY OF THE INVENTION

A novel technique for fine polishing surfaces of diamond to the submicron level involves applying to the diamond surface an oxygen-emitting polishing medium, either a dry powder or a powder dispersed in a liquid carrier. The diamond surface is then polished by high speed rubbing to a submicron finish by inducing oxygen emission and oxygen-carbon interaction. Several embodiments of apparatus for polishing are described.

BRIEF DESCRIPTION OF THE DRAWINGS

The nature, advantages and various additional features of the invention will appear more fully upon consideration of the illustrative embodiments now to be described in detail in connection with the accompanying drawings. In the drawings.

It is to be understood that the drawings are for purposes of illustrating the concepts of the invention and are not to scale.

DETAILED DESCRIPTION

Figure 1:
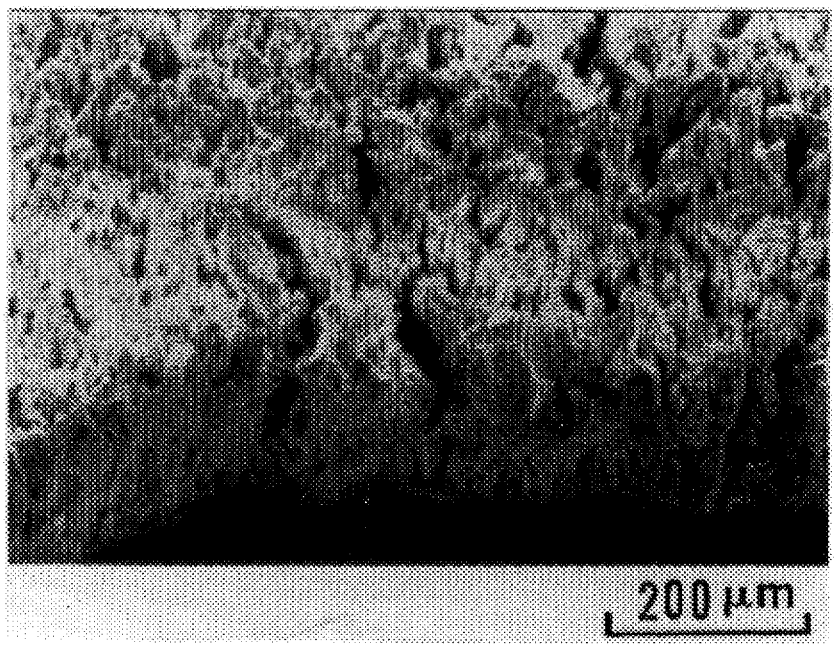
FIG. 1 represents a micrograph showing a CVD diamond film etched with oxygen gas.

In the present invention, a uniquely controlled gas-carbon interaction is utilized for fine-scale diamond polishing. The etching of diamond by oxygen gas through the formation of CO or $CO_2$ at high temperatures is well known. Unfortunately such processing is not suitable for CVD diamond polishing due to the preferential grain boundary etching. FIG. 1 is a scanning electron microscopy photograph of a polycrystalline CVD (chemical-vapor-deposited) diamond film etched by oxygen gas at 800° C. for 1 hr. As can be seen, the grain boundary etching is severe, producing a canyon-like structure.

The present applicants realized that if one can localize the oxygen-diamond etching reaction to only controlled locations, e.g., the abrading contact points between a powder and the diamond surface, then the problem of preferential grain boundary etching can be minimized. This localization can be achieved if the polishing medium material emits oxygen only when it is heated to a few to several hundred degrees centigrade by abrading friction. Such oxygen-emitting compounds are chosen, for example, preferably from silver oxide or peroxide ($Ag_2O$, AgO), antimony pentoxide ($Sb_2O_5$), manganese peroxide ($MnO_2$), potassium nitrate ($KNO_3$), chromium trioxide ($CrO_3$), barium peroxide ($BaO_2$), palladium oxide (PdO), vanadium pentoxide ($V_2O_5$), and silver nitrate ($AgNO_3$). These oxygen-containing compounds tend to decompose upon heating and emit oxygen. For example, $CrO_3$ decomposes at ~250° C. to $Cr_2O_3$ and oxygen. $AgNO_3$ decomposes at ~440° C. into metallic Ag, nitrogen, oxygen and nitrogen-oxide. The powders of these compounds may be used for polishing either in dry form or mixed with liquid carrier such as water, a water-solvent mixture or any non-flammable liquid. It is desirable that the oxygen-emitting powder does not chemically react with the liquid carrier.

An alternative form of the inventive method is the use of oxygen-emitting liquid instead of oxygen-emitting solid powder. For example, solutions of hydrogen peroxide ($H_2O_2$), hydrochlorous acid (HCIO), chromic acid ($CrO_3$ in water), $HNO_3$, $H_2SO_4$ or their mixture may be mixed with non-reacting or weakly reacting metal or ceramic powder (e.g., Mo, Ni, $Al_2$ $O_3$, AIN, MgO) and abraded onto the diamond surface. Atomic-scale local heating near the particle-diamond interface region and accompanying local decomposition and oxygen emission from the liquid can cause the oxygen-carbon (diamond) reaction preferably at the particle-diamond contact points for atomic-scale polishing with minimal grain boundary pitting.

Figure 2:
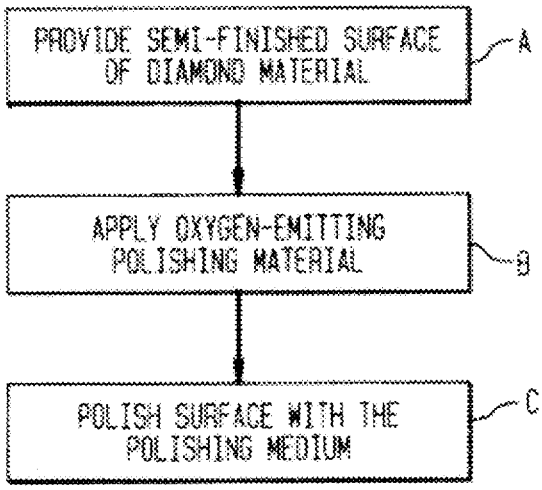
FIG. 2 is a block diagram of the processing steps involved in the polishing.

Referring to the drawings, FIG. 2 is a block diagram of the steps in fine polishing a surface of diamond material. The first step (block A) is to provide a surface of diamond material to be polished. The surface can be composed of polycrystalline or single crystal material. Typically it will be a diamond film with a semi-finished or as-deposited surface ready for final polishing. It is preferred that the surface to be polished have a starting surface roughness on the order of a few microns or less and at least about 50 Å. Surface roughness as used herein is the root-mean-square (r.m.s.) value as determined by atomic force microscopy. Such a semi-finished surface can be obtained by conventional mechanical polishing or by the aforementioned high-temperature (~700°–900° C.) diffusion reactions.

The material to be polished may have flat, curved or wavy surfaces depending on the specific application. Curved surfaces, for example, are useful for refractive diamond lenses. Wavy surfaces are useful in diamond Fresnel lenses. Both curved and wavy surfaces can be polished to smooth (but non-flat) surfaces.

The second step (Block B in FIG. 2) is to apply to the surface to be polished an oxygen-emitting polishing medium. A polishing medium is deemed oxygen-emitting for these purposes if it emits oxygen locally when heated by rubbing. Preferably it is a material which emits oxygen at a temperature of less than 500° C. and preferably less than 200° C. Preferably the polishing medium is a powder mixed in a liquid carrier. The oxygen-emitting component of the medium can be either the powder or the liquid. In a preferred embodiment, the powder is oxygen-emitting.

The oxygen-emitting powders typically have maximum particle size predominantly (>90% by weight) in the range of 1–1000 μm, and preferably in the range 5–200 μm. Other non-active fine particles such as silica ($SiO_2$) or alumina ($Al_2O_3$) may be added for controlling the viscosity of the polishing medium and for ease of handling.

The third step in FIG. 2 (block C) is to polish the surface by rubbing. High speed rotating or reciprocating pads or rubbing brushes may be used. For high polishing speed and for enhancing local heating at the contact points, the desired speed of brush motion is in the range of 10–10,000 rpm rotation or equivalent linear speed, and preferably in the range of 100–1000 rpm.

The processing method according to the invention may be followed by additional steps of dissolving off the graphitic or graphite-like carbon layer that may form under certain diamond-oxygen interaction conditions. For example, as disclosed by M. A. Plano, *Diamond: Electronic Properties And Applications,* Chap. 9, p. 356, incorporated herein by reference, a saturated solution of $CrO_3$ in $H_2SO_4$ and a boiling solution of $H_2O_2$ and $NH_4OH$ may be used.

The exact mechanism of polishing is not completely understood, but it is believed that there is instantaneous, atomic-scale heating during abrasion of the powder against the elevated portion of the diamond surface. This abrasion causes, at the contact points, decomposition of the powder material and atomic-scale emission of oxygen which takes away carbon atoms from the diamond surface via formation of CO or $CO_2$, resulting in an atomic-scale polishing.

The nominal temperature of the polishing medium is preferably kept near ambient room temperature for the sake of convenience, but it can be raised to as high as ~500° C. (but preferably below ~200° C.) if a high polishing rate is desired. The brush is preferably made up of a chemically inactive polymer, plastic, or glass fiber. Brushes may also be made of metals such as stainless steel, aluminum, or titanium alloy. Alternatively, the brush itself can also be made of or coated with oxygen-emitting materials discussed above. In the latter case the brush material actively participates in the polishing reaction as a consumable material.

Figure 3:
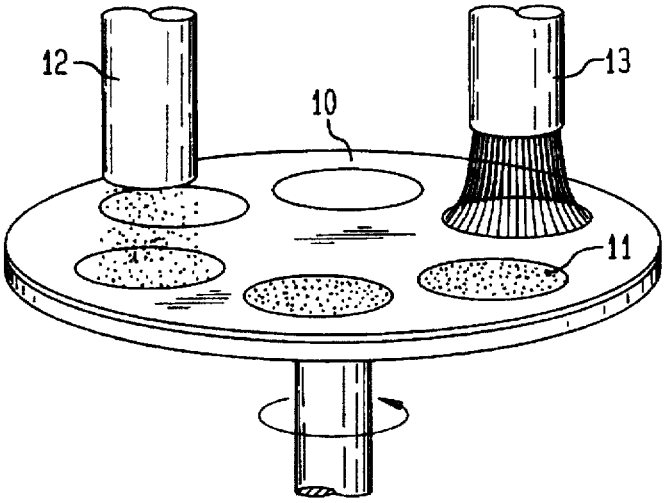
FIG. 3 schematically illustrates a first embodiment of polishing apparatus useful in the process of FIG. 1.

FIG. 3 illustrates preferred apparatus useful in practicing the method of FIG. 2. The apparatus comprises a support member such as a rotatable plate 10 for holding one or more of samples 11 to be polished (e.g. diamond films), a conduit such as tube 12 for applying the polishing medium, and a movable polishing member 13 such as a rotatable brush. The plate 10 is preferably made of or coated with non-corrosive materials, such as glass, ceramic, polymer, stainless steel or aluminum. In operation, the samples 11 are mounted on the plate 10 and the polishing medium is supplied through tube 12. The plate is rotated, and the samples are polished by brush 13.

Figure 4:
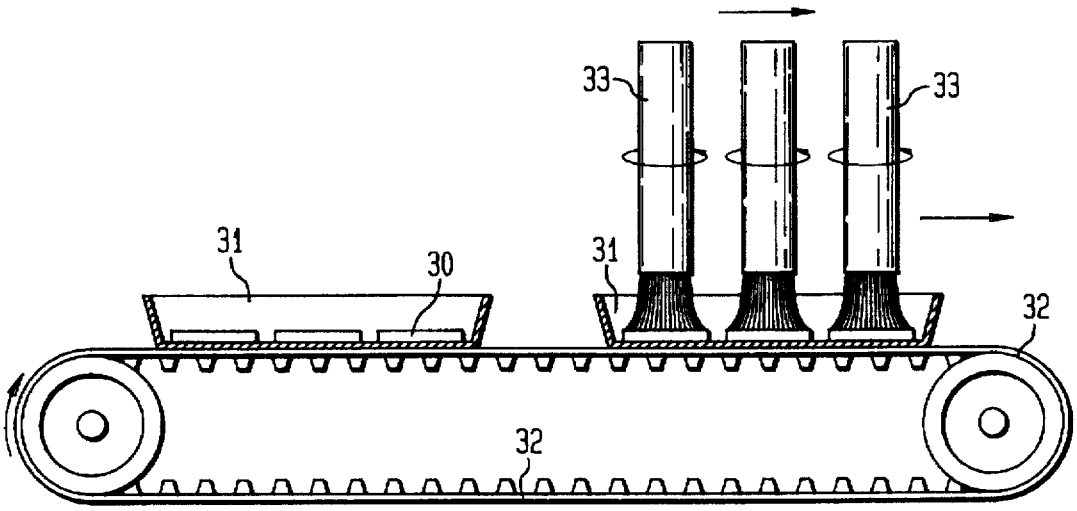
FIG. 4 shows a second embodiment of the polishing apparatus.

FIG. 4 is a polishing apparatus suitable for continuous operation. Here samples 30 are placed in a series of containers 31 which in turn are placed on a movable conveyer belt 32. One or more tubes (not shown) are provided for continuously supplying the polishing medium onto the sample surface. The samples are polished by rotating brushes 33 that advantageously travel at the same speed as the conveyer belt.

Figure 5:
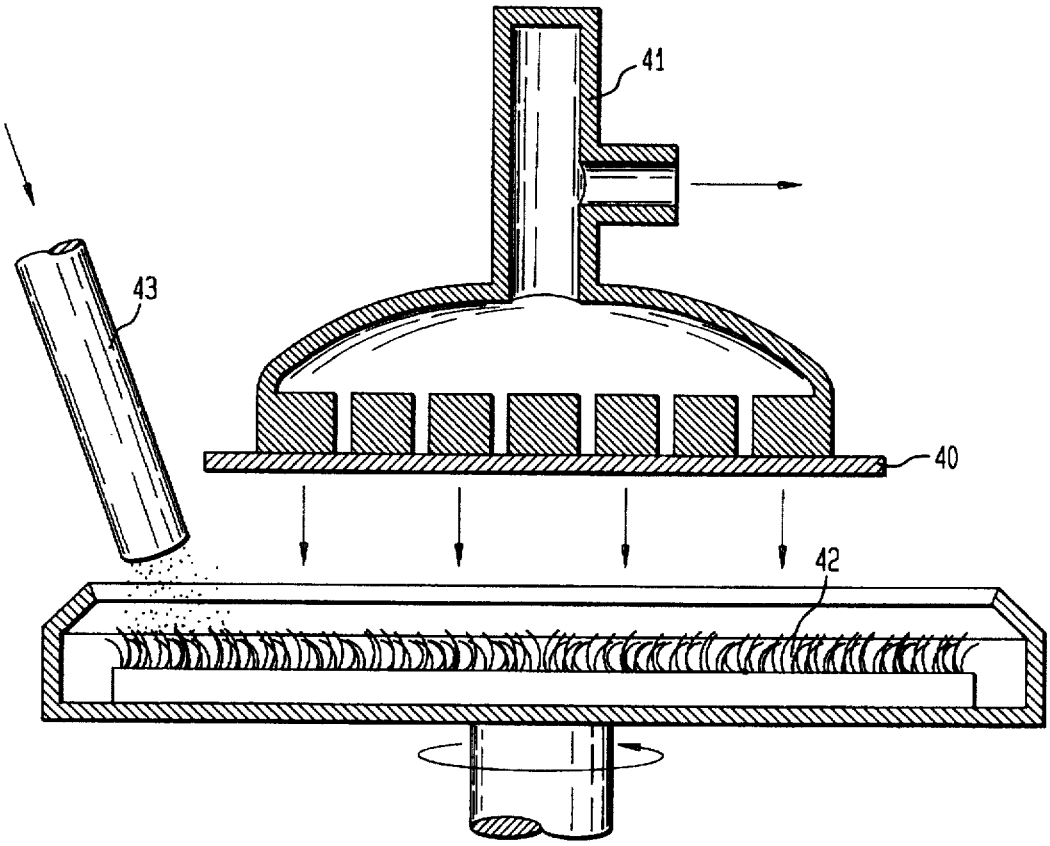
FIG. 5 shows a third embodiment of polishing apparatus.

FIG. 5 shows a third polishing apparatus. Here the samples 40 can be held upside down on the bottom of vacuum suction holder 41, which is then lowered onto a rotating polishing pad or brush 42 wet with the polishing medium via tube 43. Alternatively, the sample can be placed on the bottom of the sample holder by mechanical means or by gluing.

Figure 6:
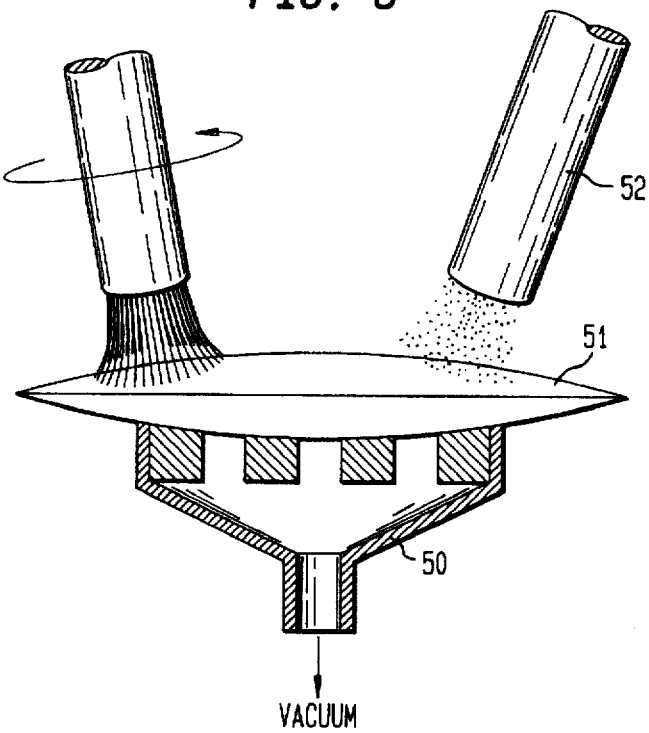
FIG. 6 shows a fourth embodiment of polishing apparatus.

FIG. 6 shows an alternative polishing apparatus particularly useful for polishing non-planar surfaces such as lenses. The apparatus comprises a sample holder 50 such as a vacuum holder for holding a lens 51, a tube 52 for delivering the polishing medium, and a polishing element 53 such as a rotating brush which can be laterally moved around.

It is to be understood that the above-described embodiments and examples are illustrative of only a few of the many possible specific embodiments which can represent applications of the principles of the invention. Numerous and varied other arrangements can be devised by those skilled in the art without departing from the spirit and scope of the invention.

The invention claimed is:

1. A method for fine polishing a diamond material without the use of a diamond polishing surface or diamond grit comprising the steps of:

providing a surface of said material having a surface roughness in excess of about 50 Å;

applying to said surface of said material an oxygen-emitting polishing medium, said polishing medium locally emitting oxygen upon heating by rubbing; and rubbing said surface of said material with a brush or pad at a sufficient speed to produce only local emission of oxygen from said polishing medium, thereby producing a fine-polished diamond surface having a surface roughness reduced by at least 10 Å.

2. The method of claim 1 wherein said polishing medium consists of an oxygen-emitting powder and a liquid carrier.

3. The method of claim 1 wherein said polishing medium consists of an oxygen-emitting powder.

4. The method of claim 3 wherein said oxygen-emitting powder comprises a powder chosen from $Ag_2O$, AgO, $Sb_2O_5$, $KNO_3$,$CrO_3$, $MnO_2$, $BaO_2$, PdO, $V_2O_5$ and $AgNO_3$.

5. The method of claim 3 wherein the particles of said powder have maximum particle size predominantly in the range 5–200 micrometers.

6. The method of claim 1 wherein said polishing medium consists of an oxygen-emitting liquid.

7. The method of claim 6 wherein said oxygen-emitting liquid comprises a liquid chosen from $H_2O_2$, HClO, aqueous $CrO_3$, $HNO_3$, or $H_2SO_4$.

8. The method of claim 1 wherein said rubbing is by brushing with a brush rotating in the range 100–1000 rpm.

9. The method of claim 1 wherein said rubbing by a reciprocating pad.

10. The method of claim 1 wherein said polishing medium consists of an oxygen-emitting liquid and a non-reacting powder, said non-reacting powder upon rubbing, providing local heating and inducing local generation of oxygen from said liquid.

* * * * *